United States Patent [19]

Bowen

[11] 4,081,035

[45] Mar. 28, 1978

[54] TRACTOR WITH RIPPER ATTACHMENT HAVING A COMBINED TOOL BAR AND COUNTERWEIGHT CONTAINER

[75] Inventor: Victor Ross Bowen, Bettendorf, Iowa

[73] Assignee: J. I. Case Company, Racine, Wis.

[21] Appl. No.: 764,365

[22] Filed: Jan. 31, 1977

[51] Int. Cl.[2] ..... A01B 35/14

[52] U.S. Cl. ..... 172/484; 172/611; 172/699

[58] Field of Search ..... 172/611, 484, 491, 40, 172/699, 700, 464; 280/759

[56] References Cited

U.S. PATENT DOCUMENTS

| | | | |
|---|---|---|---|
| 2,490,904 | 12/1949 | Gustafson | 172/611 |
| 2,676,524 | 4/1954 | Bashor | 172/611 |
| 2,691,334 | 10/1954 | Cannon | 172/611 |
| 2,925,872 | 2/1960 | Darnell | 172/611 |
| 3,116,797 | 1/1964 | Launder | 172/484 |
| 3,490,787 | 1/1970 | Latterman | 280/759 |
| 3,581,827 | 6/1971 | Ratcliff | 172/464 |
| 3,799,272 | 3/1974 | Watson | 172/611 |

*Primary Examiner*—Richard J. Johnson
*Attorney, Agent, or Firm*—Arthur J. Hansmann

[57] ABSTRACT

A tractor with ripper attachment having a combined tool bar and counterweight container. The tractor is commonly weighted with its mass toward the front thereof, and there is a ripper assembly attached to the rear of the tractor and having a hollow tool bar which receives counterweights, and the ripper tools are attached exteriorly of the tool bar and the entire assembly is free to move up and down on the rear of the tractor.

1 Claim, 6 Drawing Figures

TRACTOR WITH RIPPER ATTACHMENT HAVING A COMBINED TOOL BAR AND COUNTERWEIGHT CONTAINER

This invention relates to a tractor with a ripper attachment having a combined tool bar and counterweight container. More particularly, this invention relates to the counterbalancing of the weight of a loader type of tractor which normally has the weight toward the front of the tractor, and counterweights at the rear of the tractor thus counterbalance the entire tractor.

BACKGROUND OF THE INVENTION

Construction and agricultural and like tractors commonly employ counterweights at one end of the tractor for counterbalancing excessive weight at the opposite end of the tractor. Thus, counterweights which may be placed on or removed from the tractor or the attachment thereto itself are commonly employed so that the entire assembly can be best balanced relative to its wheels or ground-supporting members. Accordingly, the prior art is already aware of various arrangements for applying and supporting counterweights on tractors, and U.S. Pat. Nos. 3,492,019 and 3,517,941 show arrangements for placing counterweights on the front of a tractor and to thereby counterbalance the load or mass of the tractor at the rear thereof. Also, agricultural and construction equipment already utilizes various arrangements for counterweights and containers for receiving them, such as shown in U.S. Pat. Nos. 2,309,266 and 2,907,396 and 3,069,792 and 3,276,153. In those instances, counterweight containers or boxes are simply attached onto the implement or tractor itself, and then the counterweights are placed into the containers or boxes, as desired, and the counterweights are exposed and are subject to falling out of the container or box and are subject to weathering and like concerns. Still further, the prior art is also aware of the utilization of counterweights for counterbalancing the load supported in a loader bucket mounted on a tractor at the front thereof, and U.S. Pat. Nos. 3,231,117 and 3,902,735 show arrangements for counterbalancing the loader bucket loads with counterweights at the rear of the tractor. However, in those showings, the counterweight is again exposed and is not utilized and arranged in manners which are the objects of the present invention, and thus all of the aforementioned prior art is distinguishable from and differs from the present invention.

The present invention provides a tractor with a ripper attachment having a combined tool bar and counterweight container. That is, the tool bar itself is of a hollow configuration and extends rearwardly of the tractor and is capable of receiving counterweights which are therefore completely enclosed within the tool bar and are secured therein and are desirably disposed at a most rearward location relative to the tractor to thereby be most effective for counterbalancing the weight or load at the front of the tractor. In accomplishing this objective, there is no requirement for the provision of additional containers or mounting means or the like, such as those disclosed in the aforesaid patents, for the purpose of receiving and holding the counterweights which are normally removably disposed relative to the tractor. Thus, the counterweights employed in the present invention are completely contained and concealed, and no special mounting members are required, and only cover plates at the ends of the hollow tool bar are utilized for completely enclosing the counterweights contained within the hollow tool bar.

Other objects and advantages include the accomplishments of the aforementioned and having the counterweights of various sizes and lengths which are easily maneuvered and positioned into and out of the hollow tool bar, and even the tool bar itself is arranged to be raised and lowered under a powered cylinder assembly so that the tool bar can have the weights placed therein when it is in a lowered position and thus requires only a minimum of lifting for the operator to apply and remove the counterweights relative to the tool bar. That is, no special mounting is required for the counterweights, and thus they can be made in various lengths to specify varieties of weight for easy handling by one man and they can be made of sizes and identities according to the desired material of which they are made. This objective includes the advantage of being able to tack weld or otherwise secure several weights together into one maneuverable weight of a limited size and mass. Further, because the counterweights are not visible, the appearance of the machine is improved and also there is improved clearance, particularly when the tool bar is in the raised position, since the counterweights are not projecting from the tool bar itself but are instead enclosed therein.

The present invention has particular application in connection with crawler-type tractors, and here it will be understood that a crawler loader which has its bucket at the front end thereof is in need of counter balancing toward the rear thereof. Thus, where the present invention employs a ripper attachment for a crawler tractor, that attachment by itself does not provide sufficient counterweight for the forwardly balanced loader type tractor, especially where the ripper attachment can be utilized for a dozer type tractor which is not in need of counterbalancing toward the rear of the tractor. Accordingly, the ripper assembly attachable to either the dozer or loader tractor can be utilized for both types of tractors when the present invention is applied thereto and arranged to have the counterweights placed into the ripper tool bar and thus have the otherwise lightweight ripper assembly suitable for the dozer tractor also suitable for the loader tractor and to thereby counterbalance the forward located mass on the loader tractor.

Still further, the present invention provides the arrangement of the aforesaid counterweight accommodation and it does so in connection with an arrangement whereby the ripper assembly can be raised to only a limited upward position and thereby protect the assembly and the control power cylinder itself, even though the assembly is arranged to receive and accommodate the counterweights in the tool bar element of the assembly.

Other objects and advantages will become apparent upon reading the following description in light of the accompanying drawings.

DETAILED DESCRIPTION OF THE PREFERRED EMBODIMENT

Figure 1:
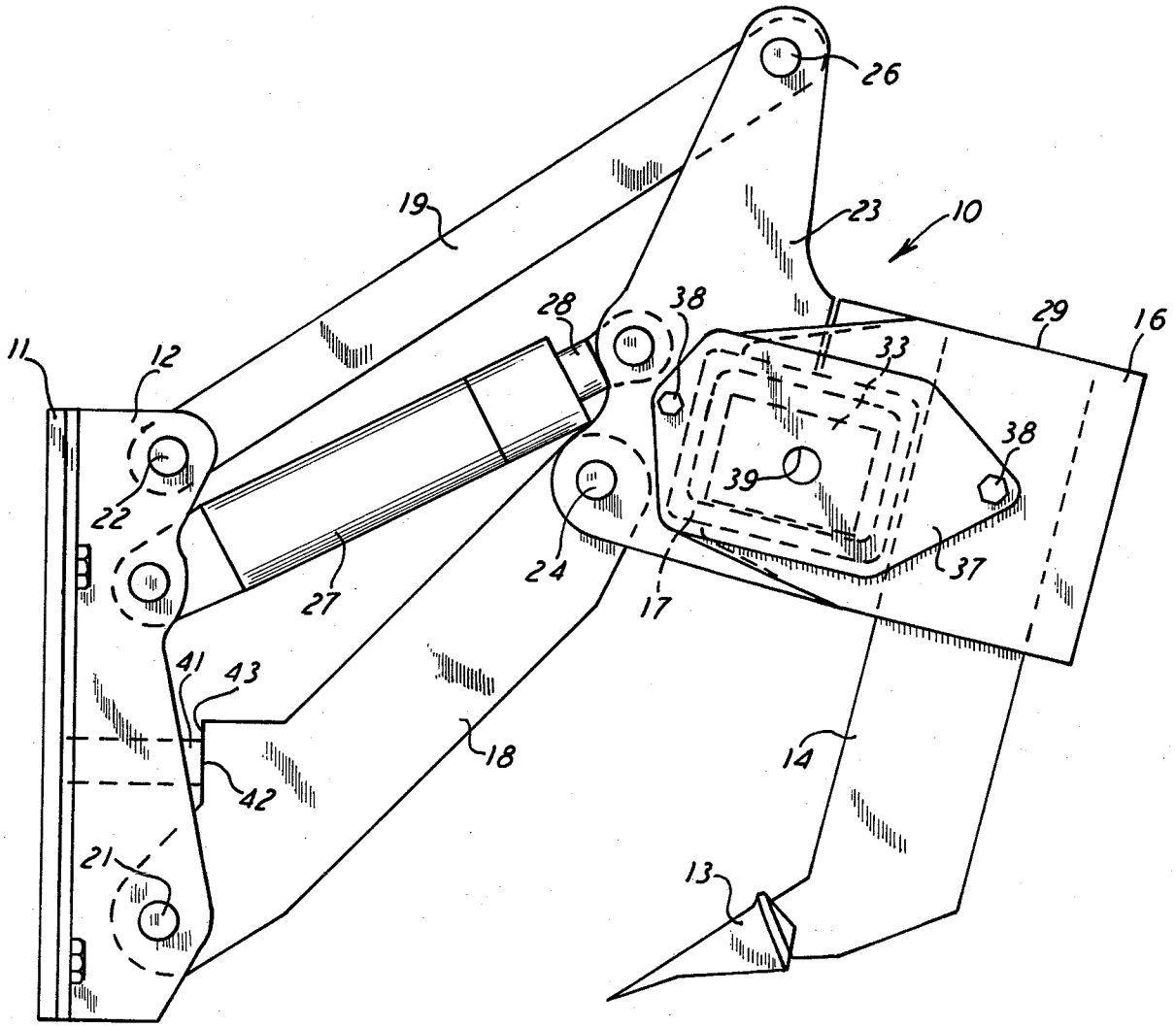
FIG. 1 is a side elevational view of the ripper assembly shown mounted on the rear fragment of a tractor.

FIG. 1 shows a ripper assembly, generally designated 10, movably mounted on the rear of a crawler type tractor which is shown to have the rear plates 11 and 12 to which the assembly 10 is movably mounted for up-and-down movement, in the usual manner. The assembly 10 includes the ripper member 13 which has an upstanding shank portion 14 suitably attached to spaced-apart plates 16 which are secured to a hollow tool bar 17 forming a part of the assembly 10. Also, pivotally-mounted links 18 and 19 are included in the assembly 10, and they are pivotally mounted on the tractor by means of pins 21 and 22 which are secured to the plate 12, and one skilled in the art will readily understand that there are two plates 12 spaced apart at the rear of the tractor for securing the pins 21 and 22 as shown in FIG. 1. Thus the assembly 10 also has a plate 23 which is suitably secured to the tool bar 17, such as by welding or the like, and the rearward ends of the links 18 and 19 are pivotally attached to the plate 23 through the pivot pins 24 and 26.

As such, the pivotal mounting for the assembly 10 at the rear of the tractor 11 is in the nature of a parallelogram mounting, and thus the tool bar 17 can be moved up and down relative to the tractor 11, and the movement is substantially in a vertical direction. A powered cylinder assembly 27 is also pivotally connected between the tractor 11 and the assembly plate 23, and suitable power controls of a hydraulic nature are preferably connected with the assembly 27 for the usual extension and contraction of the assembly piston rod 28 to thereby induce the up-and-down movement in the ripper assembly 23.

Figure 4:
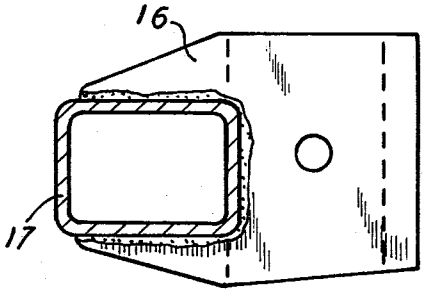
FIG. 4 is a sectional view taken along the line 4—4 of FIG. 2.
Figure 3:
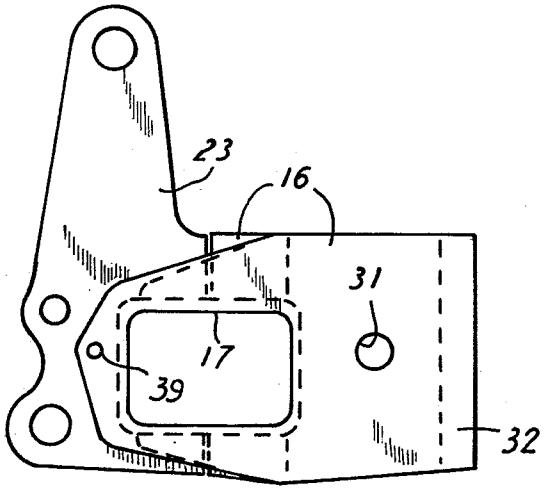
FIG. 3 is an end elevational view of FIG. 2.
Figure 2:
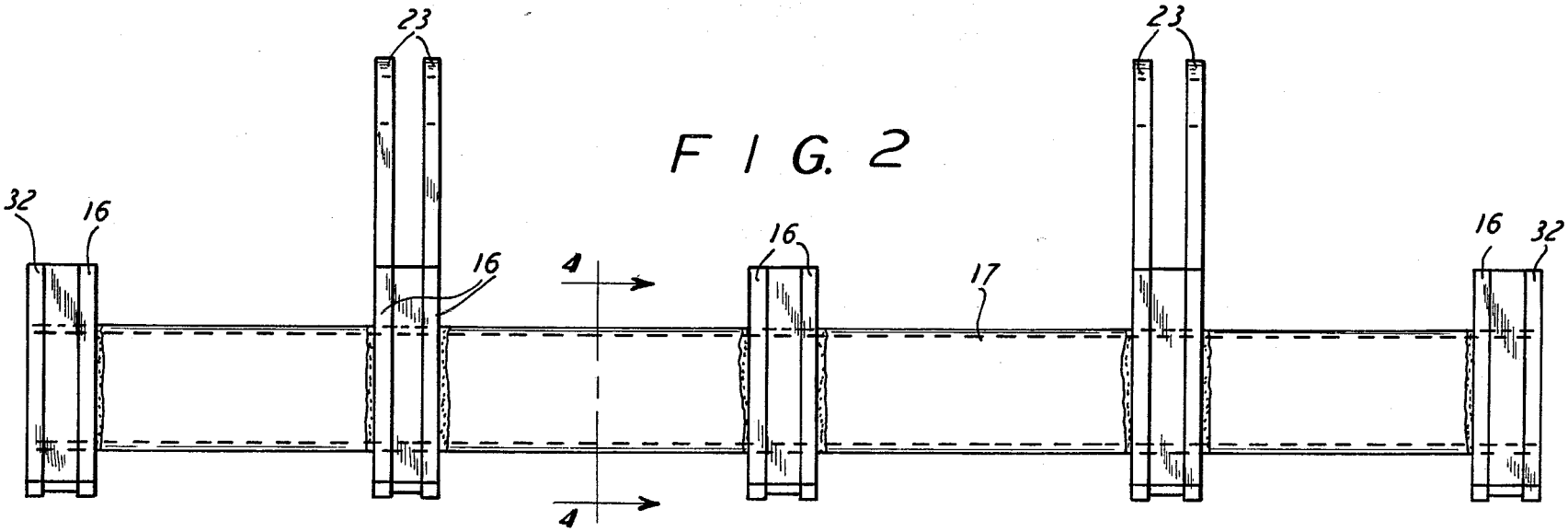
FIG. 2 is a rear elevational view of the tool bar portion of the assembly of FIG. 1.

Accordingly, FIG. 2 shows that the tool bar 17 is elongated and has the plates 16 and 23 affixed thereto at locations along the length of the tool bar 17. As such, there would be two links 19 connecting to each pair of plates 23, as seen in FIG. 2, and of course there would also be two links 18 connected to the two pairs of plates 23. FIG. 2 further shows that there are pairs of plates 16 located at spaced-apart locations along the length of the tool bar 17, and each pair of plates 16 receives the shank 14 of the ripper member so that a plurality of ripper members are mounted on the tool bar 17 at spaced-apart locations relative to the length or axis of the tool bar 17. Anyone skilled in the art should readily understand the arrangement of the tractor and the ripper assembly mentioned and described herein, and U.S. Pat. No. 3,527,308 also shows an arrangement of a crawler type tractor and a ripper assembly at the rear thereof and having a horizontally-disposed tool bar and ripper members depending therebelow, and that prior art showing is incorporated in this description. However, it should be noted and fully understood that in the present invention the tool bar 17 is elongated and of a hollow configuration having an endless girth in the direction transverse to the longitudinal axis thereof, as shown in the sectional view in FIG. 4, and that girth is of a general rectangular configuration. Also, the ripper shanks 14 are attached to the tool bar 17 to be offset therefrom and fully exteriorly related to the hollow tool bar 17, rather than passing through the tool bar and obstruct or impede the arrangement of the hollow interior of the tool bar 17. As such, the ripper mounting plates 16 extend rearwardly of the tool bar 17, as clearly shown in FIG. 4. Therefore, it will be understood that the ripper shank 14 extends between the spaced-apart mounting plates 16 and to the upper edges 29 of the plates 16, and the ripper shanks 14 are removable from between the plates 16 and pin openings 31 in each of the plates 16 are arranged to receive a pin which will secure the ripper shank 14 from between the plates 16, in a desired arrangement. In the actual showings, all of the plates 16 are not identical in configuration so that the plate on each opposite end of the bar 17 is of one configuration, as shown in FIG. 3, and the plate 16 which aligns with the plate 23 is of a somewhat different configuration, as also shown in FIG. 3, and the plates 16 in the center of the tool bar 17 are of still a slightly different configuration, as seen in FIG. 4. However, for purposes of a succinct description thereof, the plates 16 are considered to be the spaced-apart pairs of plates for the mounting of the ripper shanks 14, with each pair 16 receiving one shank 14, and thus the plates are all designated 16. Also, in all instances of the plates 16, they have forwardly extending portions which are shown to be welded to the tool bar 17, and the plates 16 have rearwardly extending portions 32 which are offset from the tool bar 17 and which are the portions which actually engage the ripper shanks 14 in that offset arrangement.

FIG. 2 shows that there are two plates at the opposite ends of the tool bar 17 and these plates have the portions 32 and extend transverse to the longitudinal axis of the tool bar and completely around and beyond the girth thereof, as seen in FIG. 3.

Figure 5:
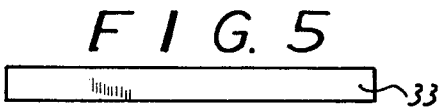
FIGS. 5 and 6 are side views of counterweights, reduced.
Figure 6:
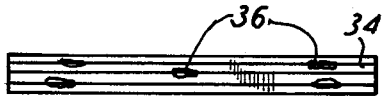

With the arrangement of the hollow tool bar 17 and the off-set plates 16 for mounting the tool or ripper member 13, the tool bar 17 is available for receiving counterweights 33 which are of an elongated configuration and which have a transverse cross-section corresponding to the rectangular transverse cross-section of the tool bar 17, as shown in FIG. 1 and in FIGS. 5 and 6. Thus, the counterweight 33 fits snugly into the tool bar 17 for at least the length of the counterweight 33, and that length would of course be something less than the total length of the tool bar 17. Therefore, there may be several counterweights 33 which can be readily slid into the tool bar 17, depending upon the desired counterweight effect required and depending upon the particular weight of each counterweight 33 so that the operator can easily lift a counterweight and not find it too large or heavy.

FIG. 6 shows that the counterweight can take the configuration shown in that counterweight 34 where there is actually a laminated type of counterweight having weldments 36, or there may be other means for attaching pieces of counterweight together to form one unitary counterweight 34 in a desired weight and overall size. In all instances, the counterweights 33 and 34 are of a desired and convenient length and they are of a cross-sectional shape to fit snugly within the girth of the tool bar 17, and the operator can easily slide them into and out of the hollow tool bar 17, especially when the tool bar 17 is in the lowered position to where it is closest to the ground.

Finally, the assembly 10 is arranged with a removable cover plate 37 on each end of the tool bar 17 to close off the ends of the tool bar 17 and thus conceal the counterweights and secure them within the tool bar 17. While only one end and one cover plate 37 is shown, such as in FIG. 1, it will be understood that there is a cover plate 37 on each end of the tool bar 17, and each cover plate 37 is adjacent the respective end plate 16 which overlaps the cover plate. Also, the cover plate 17 can be secured by holes 38 in openings 31 and 39 in end plates 16 so that the cover plates are removably affixed in the assembly 10. Further, each cover plate 37 has an access or inspection opening 39 extending therein, and the perator can therefore see whether or not there is any counterweight within the tool bar 17, and he can also use a probe rod to either determine the presence of the counterweight within the tool bar or to slide the counterweight along the tool bar 17 either for positioning the counterweight or for removing it from the tool bar 17 and that can be accomplished without removing the utilized cover plates 37 at that time.

With the arrangement of the assembly 10 as described in the foregoing, the counterweights of various length and mass can be readily and easily inserted into and removed from the hollow tool bar 17 and they are disposed at the optimum position rearwardly on the tractor assembly for maximum counterbalancing effect, all as desired. Further, since the assembly 10 is at the rearmost position of the tractor and attachment arrangement, and since the assembly 10 moves up and down, the complete enclosing of the counterweights 33 and/or 34 within the tool bar 17 assures the effectiveness of the counterbalancing and the security of retaining the weights in the unit and not having them fall out or be repositioned inadvertently. Also, when the assembly 10 is in the raised position, the tractor may be used for moving in a reverse direction which is actually toward the assembly 10, and in that event if the assembly 10 engages an obstacle, the links and particularly the cylinder assembly 27 are retained in the position shown in FIG. 1, and that is the raised position, by virtue of an abutment piece 41 affixed to the rear of the tractor 11 and extending with an abutment surface 42 which engages a matching abutment surface 43 on the link 18. That is, raising the assembly 10 against the effect of the counterweights within the tool bar is guided to the position shown in FIG. 1 where the abutting surfaces are engaged, and then if the assembly 10 is forced upon by an obstacle, the cylinder 27 is protected from damage by virtue of the abutments and limit stops described. That is, the cylinder 27 will still be under necessary pressure to support the counterweights and the entire assembly 10, but the cylinder will not be damaged if the assembly 10 inadvertently hits an obstruction since FIG. 1 shows the cylinder assembly 27 in a retracted position and the abutment surfaces 42 and 43 are engaged and thus prevent further cylinder retraction.

What is claimed is:

1. A tractor with ripper attachment having a combined tool bar and counterweight container, comprising a tractor, a ripper attachment assembly removably and pivotally connected to the rear of said tractor for up and down pivotal movement on said tractor, said assembly including a horizontally disposed tool bar and rippers connected to said tool bar and mounting links and a powered cylinder assembly interconnected between said tool bar and said tractor for the up and down pivotal movement of said assembly on said tractor, said links being disposed to present a parallelogram arrangement for the up and down movement of said assembly, said powered cylinder being of a limited contracted length and disposed for moving said assembly upwardly, an abutment on said tractor and extending to said links and abuttable with said links for limiting the upward ripper attachment assembly movement and with said abutment being positioned to engage said links when said cylinder assembly is at least near its limited retracted position, said tool bar being an elongated hollow bar having an endless girth extending along the plane transverse to the longitudinal axis of said tool bar and for the full length of said tool bar and defining the hollow interior of said tool bar which is free of any protrusions in said hollow interior, a counterweight removably disposed in said tool bar for counterbalancing the weight of said tractor and for urging said assembly downwardly, said counterweight having a cross-sectional shape similar to that of said hollow interior of said tool bar, for sliding of said counterweight into said hollow interior and for snug fitting of said counterweight in said tool bar, plates extending around the opposite ends of said tool bar and beyond said girth of said tool bar transverse to the length of said tool bar, covers removably bolted to said plates and extending over the openings in the opposite ends of said tool bar for enclosing said counterweight therein, said covers each having an opening therein for inspecting the interior of said tool bar when said covers are attached thereto, and ripper mounting members attached to said tool bar and extending transversely thereof on the exterior of said tool bar for attachment of said rippers relative to said tool bar and free of extendingthrough the hollow interior of said tool bar.

* * * * *